United States Patent [19]

Ishikawa

[11] 4,303,815

[45] Dec. 1, 1981

[54] PUSH BUTTON SWITCH ASSEMBLY

[75] Inventor: Yuho Ishikawa, Chiba, Japan

[73] Assignee: Sony Corporation, Tokyo, Japan

[21] Appl. No.: 131,835

[22] Filed: Mar. 19, 1980

[30] Foreign Application Priority Data

Mar. 22, 1979 [JP] Japan ..... 54-37128[U]

[51] Int. Cl.[3] ..... H01H 3/12; H01H 3/32

[52] U.S. Cl. ..... 200/330; 200/340; 403/372

[58] Field of Search ..... 200/340, 159 R, 159 A, 200/159 B, 5 R, 5 A, 5 D, 5 E, 314, 330; 74/483 PB, 10.1; 403/372, 365

[56] References Cited

U.S. PATENT DOCUMENTS

| | | | |
|---|---|---|---|
| 2,884,503 | 4/1959 | Connelly | 200/340 |
| 3,425,723 | 2/1969 | Parkin et al. | 403/372 |
| 3,558,165 | 1/1971 | Lundergan | 403/372 |
| 3,996,805 | 12/1976 | Clark | 200/340 |
| 4,066,860 | 1/1978 | Kawasaki | 200/340 |
| 4,156,120 | 5/1979 | Vaerlien et al. | 200/340 |

*Primary Examiner*—John W. Shepperd

*Attorney, Agent, or Firm*—Lewis H. Eslinger; Alvin Sinderbrand

[57] ABSTRACT

A push button switch assembly includes a combining member comprising an inserting portion into which an operating rod of a push button switch, which is arranged in a cabinet for electronic apparatus, is inserted. An engaging portion of the push button assembly, with which a knob inserted through an opening of a panel is engaged, is also provided and includes elastic connecting portions to connect the inserting portion to the engaging portion. The combining member is formed of synthetic resin. The knob and the operating rod of the push button switch are assembled to each other through the combining member, and they are elastically movable relative to each other in directions normal to the pushing direction of the knob when the push button switch is operated.

6 Claims, 9 Drawing Figures

PUSH BUTTON SWITCH ASSEMBLY

BACKGROUND OF THE INVENTION

1. Field of the Invention

This invention relates to a push button switch assembly and, more particularly, to a constituent portion of the push button switch assembly by which a knob and a push button switch are connected to each other.

2. Description of the Prior Art

Generally in an electronic apparatus such as a radio receiver which is operated by push button control elements, it is desirable that the push button switch is securely operated, and that the operation occurs smoothly without malfunction. The push button switch is mounted typically on a chassis through a printed board. An operating rod of the push button switch is fitted into a hole made in the end surface of the knob and the knob is guided by an escutcheon fixed within an opening of the front panel of the receiver. Since there is some error in the forming accuracy, working accuracy and assembling accuracy of the chassis, printed board and the panel, there is the possibility that the hole of the knob is deflected from the operating rod of the push button switch. In that case, when the operating rod is forcibly inserted into the hole of the knob, the knob and the escutcheon chafe against each other when the knob is pushed. Moreover, there is the possibility that the knob, when pushed again to release the selected operation, may not move back to the original position on releasing.

A push button switch assembly has been proposed which obviates the above-described disadvantage but not without eliminating certain other undesirable attributes. Such prior art push button assembly is illustrated in FIG. 1 and will be described in more detail to provide a better understanding and background to appreciate the push button assembly of the present invention.

As shown in FIG. 1, the prior art push button assembly 1 includes a depressible push button member or knob 2 slidably disposed and guided within an opening 3 of an escutcheon member 4 which is in turn mounted within an opening 5 within the front panel 6 of the electronic device such as a receiver (not shown). Knob 2 includes a flanged portion 7 disposed on the interior facing side of the knob which bears against the surface of escutcheon 4 to limit outward movement of the knob. The assembly also includes a push button switch 8 mounted on a printed circuit board 9 within the cabinet of the electronic device. Push button switch 8 includes an operating rod 10 extending therefrom which has its free end 11 in contact with flange 7 of knob 2. Operating rod 10 is urged to remain in contact with knob 2 by a coil spring 12 which has one end disposed against a flange 13 extending from rod 10 and its other end against a flange 14 on the housing of push button switch 8.

When the knob 2 is depressed operating rod 10 moves against the spring action of spring 12 into the housing of the push button switch 8, by a predetermined length, and is retained. When knob 2 is again depressed operating rod 10 is projected back to its original position. In the push button switch assembly of the prior art shown in FIG. 1 no hole is provided for fitting the operating rod 10 in the end surface of the knob 2 and knob 2 is not fixed to operating rod 10. End 11 of operating rod 10 merely contacts flange 7 of knob 2. Accordingly, the contact position between the knob 2 and operating rod

10 may change in the direction normal to the pushing direction of the knob 2. Even when the central axis X of the knob 2 or that of the opening 3, as shown in FIG. 1, is deflected from the central axis Y of operating rod 10 by the length G, or even when the push button switch 8 is inclined from the horizontal position shown in FIG. 1, knob 2 can be pushed without trouble and knob 2 is not retarded in its movement by escutcheon 4. Thus, push button switch 8 can be operated through the operating rod 10 by the knob 2.

However, when panel 6 is removed from the electronic device during disassembly, for example to repair the device, there is the possibility that knob 2 may fall from the escutcheon 4 into the cabinet. If knob 2 is made of metal, there is the possibility that it may short-circuit one or more of the circuit elements of the printed circuit board 9 causing more damage to the apparatus. Accordingly, much care must be taken in disassembling the apparatus and handling of the apparatus for disassembly is made more troublesome.

To solve the above-described problem, a push-button switch assembly, shown in FIGS. 2 to 4 has been proposed. Parts in FIG. 2 to FIG. 4 which correspond to those in FIG. 1, are denoted by the same reference numerals and further description of these parts will be omitted.

In the prior art push button assembly shown in FIGS. 2 to 4 the operating rod 10 of push button switch 8 is fitted to a combining member 20, shown in FIG. 3, which comprises a square cylindrical segment **20*b* having a square shaped penetrating hole 20*a* and a pair of opposed support plates 20*c* fixed to the side wall of the cylindrical segment 20*b*. The combining member 20 is inserted into a cap-like knob 22, FIG. 4, which includes an interior recess 24, a pair of opposed cutouts 25 and a pair of holding arms 23 formed by each cutout 25. Each of the cutouts 25 comprises a slit 25*a* extending along the periphery of knob 22 and a contiguous opening 25*b*** extending toward the open end.

The above described parts are assembled in the manner shown in FIG. 2. The operating rod 10 of the push button switch 8 is fitted into the penetrating hole **20*a* of the combining member 20, and support plates 20*c* of the combining member 20 are inserted into the slits 25*a* of knob 22. An engaging groove 10*a* is formed in operating rod 10 to engage with a projection 20*d* formed in the inner wall of combining member 20**.

The cylindrical part **20*b* of combining member 20, to which operating rod 10 of push button switch 8 is fitted, is inserted into recess 24 of knob 22 so that support plates 20*c* are placed at openings 25*b*. Knob 22 is then rotated in the direction shown by arrow A in FIG. 4**.

However, while this type assembly obviates the problem of losing a knob during disassembly of the apparatus this knob assembling operation is troublesome. When the width of slits **25*a* are nearly equal to the thickness of support plates 20*c*, or the slits are slightly smaller than the plates, to firmly hold support plates 20*c*, the support plates 20*c* must be forcibly inserted into slits 25*a*. If the support plates 20*c* are formed of a weak material, there is the possibility that they will break off during assembly. If push button switch 8 is mounted on a slant on printed circuit board 9, knob 22 may be caught by the escutcheon 4 since knob 22 is firmly coupled with combining member 20. Thus push button switch 8** cannot be operated smoothly in such a situation.

When the width of slits 25a are made larger than the thickness of support plates 20c, to avoid the above-described disadvantage, as shown in FIG. 2, knob 22 cannot be securely held and the knob 22 is apt to move about to make for sloppy operation and to vibrate during use which may add an undesirable vibrating noise.

SUMMARY OF THE INVENTION

Therefore it is an object of the present invention to provide a push button switch assembly in which the above-described defects of the prior art combining members used in push button assemblies are obviated.

Another object of the present invention is to provide a push button switch assembly which is simple to assemble on an electronic device.

A further object of the present invention is to provide a push button switch assembly in which a push button is securely combined with a push button knob for ease of smooth, trouble free operation.

A still further object of the present invention is to provide a push button switch assembly in which a push button knob is securely held to avoid undesirable vibration and which does not interfere in any way with an escutcheon and does not make any noise even when vibrated.

A still further object of the present invention is to provide a push button switch assembly in which the pushing operation of the knob may not be interrupted.

In accordance with an aspect of this invention, a push button switch assembly is provided comprising a push button switch, a push button knob and an operating rod combined with the push button switch and knob. The operating rod is formed of synthetic resin and is combined with the switch and knob by an inserting portion into which the operating rod of the push button switch is inserted. An engaging portion is also provided which engages with the knob for holding the knob and plural elastic connecting members are provided to connect the inserting portion to the engaging portion.

Other objects, features and advantages of the present invention will be apparent from the following description taken in conjunction with the accompanying drawings.

DESCRIPTION OF THE PREFERRED EMBODIMENTS

Figure 2:
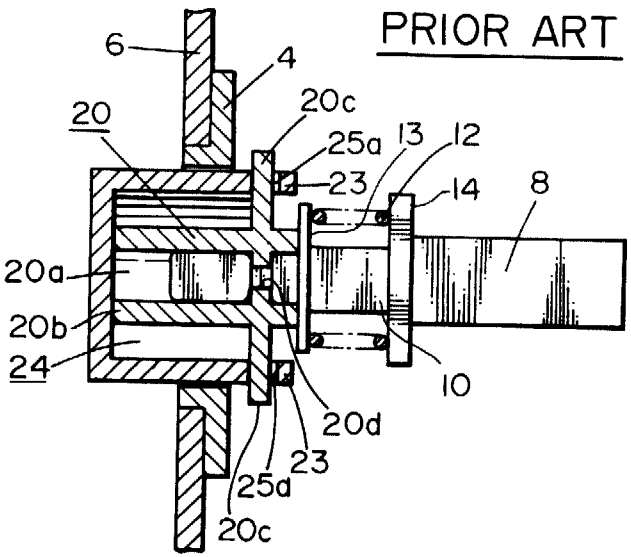
FIG.2 PRIOR ART
FIG. 2 is a cross-sectional view of another prior art conventional push button switch assembly.
Figure 1:
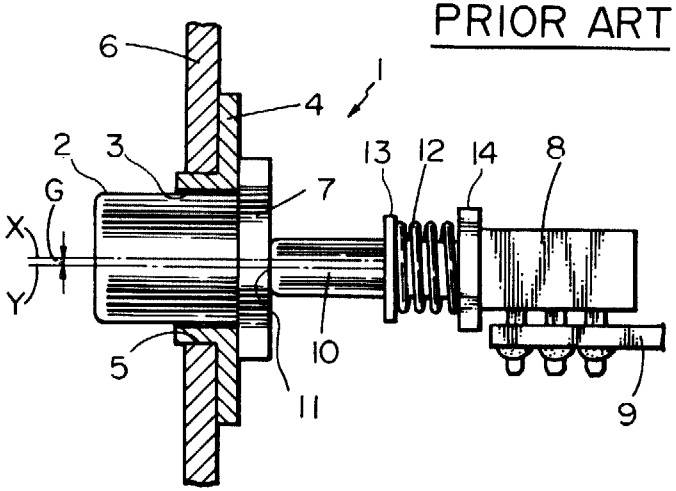
FIG.1 PRIOR ART
FIG. 1 is a cross-sectional view of a prior art conventional push button switch assembly.
Figure 4:
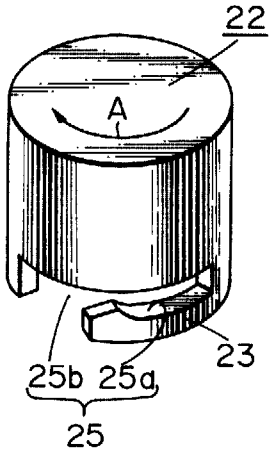
FIG.4 PRIOR ART
FIG. 4 is a perspective view of a knob in the assembly of FIG. 2.
Figure 3:
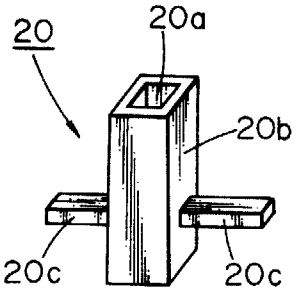
FIG.3 PRIOR ART
FIG. 3 is a perspective view of the combining member in the assembly of FIG. 2.
Figure 5:
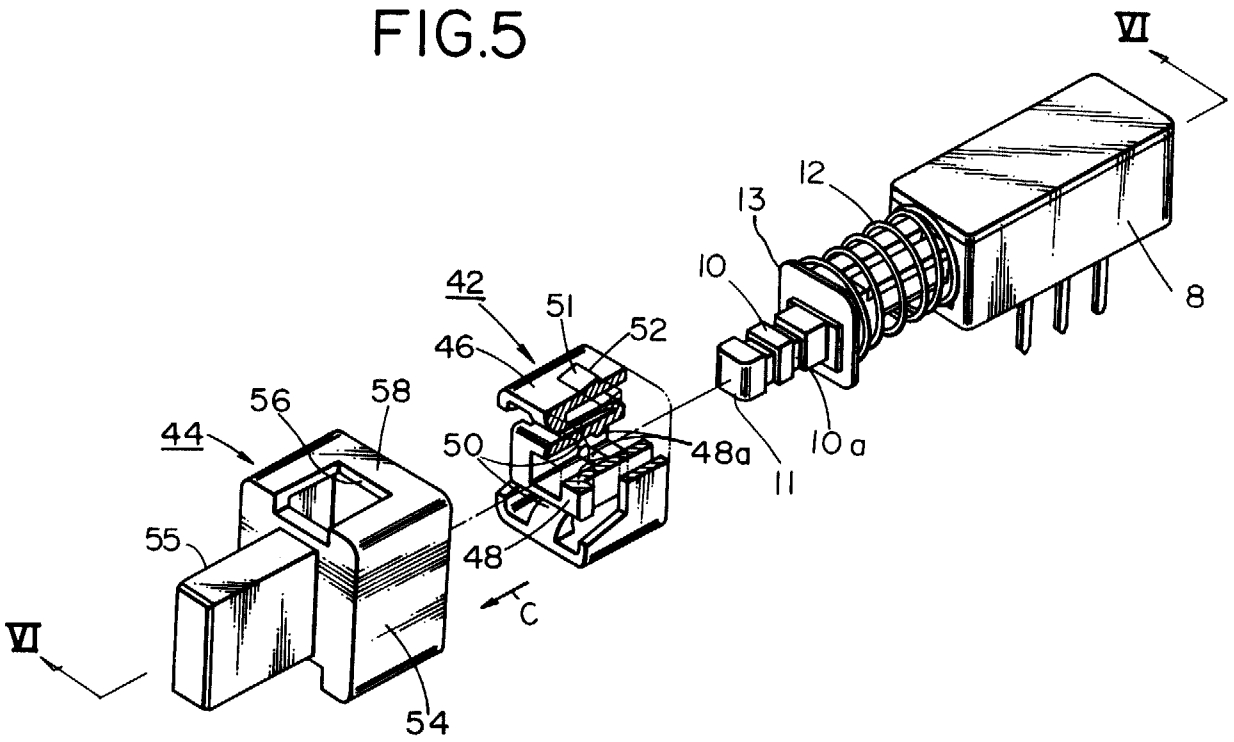
FIG. 5 is an exploded perspective view of a push button switch assembly according to one embodiment of this invention.

A push button switch assembly according to one embodiment of the present invention will be described with reference to FIGS. 5 to 7. Like parts in FIGS. 5 to 7 which correspond to those in FIGS. 1 to 4 are denoted by the same reference numerals and the description of these will be omitted.

The push button assembly of the present invention includes a combining member 42 to combine a push button assembly 44 with the push button switch 8. The combining member 42 is preferably formed of an elastic and flexible synthetic resin, for example such as Nylon, and includes an outer square-shaped cylindrical member 46 and a spaced inner square-shaped cylindrical member 48. The combining member 42 may be molded as an integral unit. The outer cylindrical member 46 engages with a push button knob 44 and the inner cylindrical member 48 engages with an operating rod 10 of a push button switch 8. The outer and inner cylindrical members 46 and 48 are elastically interconnected by a pair of opposed connecting members 50 disposed opposite to each other so that the inner cylindrical member 48 is arranged substantially in the center of the outer cylindrical member 46.

Operating rod 10 of push button switch 8 includes an engaging groove 10a near the free end 11 which is inserted into the inner cylindrical member 48 where an extending projection 48a engages groove 10a to interconnect operating rod 10 with cylindrical member 48.

Connecting members 50 are thin and narrow segments to provide a flexible and somewhat elastic interconnection in a radial and circumferential direction between outer member 46 and inner member 48. Thus each connecting member 50 extends from the outer peripheral surface of inner member 48, on the right as viewed in FIG. 6, to the inner peripheral surface of outer member 46, on the left as viewed in FIG. 6. As a result of this interconnection by the pair of interconnecting members 50, at opposed locations, the outer and inner cylindrical members are movable with respect to each other in all directions except in the direction indicated by arrow B in FIG. 6, that is in the direction of movement of the push button. However, the interconnection allows for misalignment or relative twisting movement between the inner and outer cylindrical members to accommodate discrepancies in alignment which may occur due to manufacturing tolerances.

Push button assembly 44 includes a square, in cross-section, portion 54 having a recess formed therein formed integrally with an extending push button element 55. Assembly 44 is formed of a hard synthetic resin. Portion 54 includes diametrically opposed openings 56 formed in opposite side walls of the square-shaped portion 54. Openings 56 are designed to receive opposing engaging claws 52 having slant surfaces 51 which are formed on opposite walls of the outer cylindrical member 46 of combining member 42. Thus combining member 42 and square-portion 54 are interconnected by the engagement of claws 52 within openings 56. To interconnect push button assembly 44 with combining member 42 in the combining operation, member 42 is moved toward push button assembly 44 in the direction shown by the arrow C in FIG. 5. The slant surfaces 51 of the engaging claws 52 are elastically deformed by the inserting force applies in the direction of arrow C. When slant surfaces 51 are clear of restraint in push button assembly 44, that is within openings 56, engaging claws 52 are elastically restored to their original positions and engage surface sections 58 which define the rearmost extent of openings 56. When the cross section of the outer circumferential surface of combining member 42 substantially coincides with the inner circumferential surface of the square portion 54, the combining member 42 is closely interlocked wth the square portion 54 without any substantial gap. Thus the combining member 42 is precluded from separating from the square portion 54 of push button assembly 44 if disassembly is necessary.

The square-shaped portion 54 of push button assembly 44 is connected through the combining member 42 to operating rod 10. Since the combining member 42 is interposed between the square-shaped portion 54 and operating rod 10, push button assembly 44 and operating rod 10 may move freely in all directions except the pushing direction for operating the push button switch 8.

Figure 6:
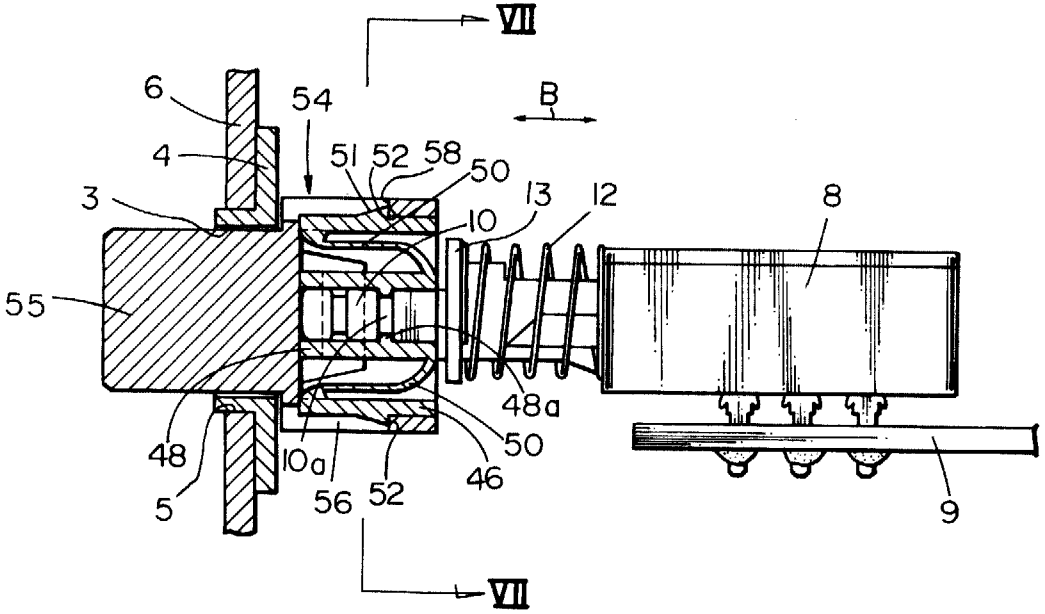
FIG. 6 is a cross-sectional view of the push button switch assembly of FIG. 5.
Figure 7:
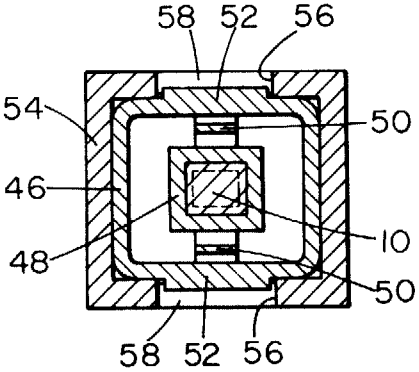
FIG. 7 is a cross-sectional view taken along line VII—VII in FIG. 6.

The push button switch assembly as shown in FIG. 6 is mounted on panel 6 in such a manner that the knob portion 55 is fitted through escutcheon 4 mounted on the panel 6.

In operation when push button assembly 44 is in an undepressed state, square-shaped portion 54 of assembly 44 is in contact with escutcheon 4 under urging of spring 12. When knob portion 55 is depressed to activate push button switch 8, combining member 42 and operating rod 10 together with push button assembly 44 are all moved a predetermined distance in the pushing direction against the force of spring 12. With this movement operating rod 10 is also withdrawn a predetermined distance into the housing of push button switch 8 and is locked there to effect the desired change-over operation. When push button element 55 is again depressed, combining member 42, operating rod 10 and push button assembly 44 are all moved back to their original positions under the urging of spring 12 to the position shown in FIG. 6.

If there are some errors in the manufacturing accuracy of the chassis and printed circuit board 9, or if the chassis and the printed circuit board 9 are warped, the central axis of the operating rod 10 is deflected from the central axis of the opening 3 and the push button assembly 44 is eccentric to operating rod 10. However, the eccentricity is compensated by connecting members 50 formed in the combining member 42. Moreover, the play between push button assembly 44 and escutcheon 4 is also compensated by connecting members 50. Thus, push button assembly 44 may always be moved smoothly and positively in the pushing direction.

Thus when combining member 42 is used in the push button switch assembly any deflection of push button assembly 44 from operating rod 10 is effectively cancelled by the pairs of connecting members 50 and when push button assembly 44 is depressed there is no likelihood of any interference with escutcheon 4. The push button moves smoothly and positively back and forth without any tendency to vibrate.

While the present invention has been described as embodying a square-shaped push button it is readily understood that any other shape may be employed such as a round shape. In this case, the outer cylindrical member 46 could be provided with a circular cross-section.

It is also evident that each of the connecting members 50 while described as being connected at one end to the knob side end of the inner circumferential surface of the outer cylindrical member 46 and the other end to the spring side end of the outer circumferential surface of the inner cylindrical member 48, that in contrast to such connection, each of the connecting members 50 may be connected in the opposite manner.

Figure 8:
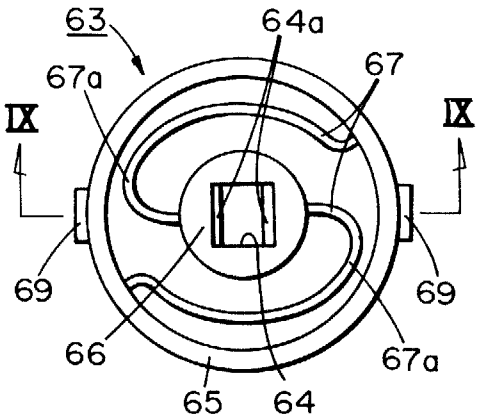
FIG. 8 is a bottom view of a combining member of a push button switch assembly according to another embodiment of this invention.
Figure 9:
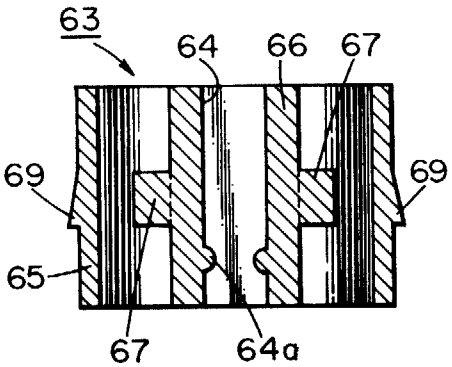
FIG. 9 is a cross-sectional view taken along line IX—IX in FIG. 8.

Reference is now made to FIGS. 8 and 9 for a description of a second embodiment of the present invention. In this embodiment, a modified combining member 63 is used instead of the combining member 42 of FIG. 6. Combining member 63 is formed of synthetic resin as one body and it includes an outer round cylindrical portion 65 with which the push button assembly 44 is engaged. An inner round cylindrical portion 66 is also provided to which the free end of an operating rod 10 is fitted. The inner cylindrical portion 66 has a through hole 64 provided with a rectangular cross-section into which the free end of operating rod 10 is inserted.

Outer cylindrical portion 65 and inner cylindrical portion 66 are interconnected to each other by a pair of thin, narrow connecting bands 67. As clearly shown in FIG. 8, connecting bands 67 have curved portions **67*a* and extend in an S-shape form as one body. Inner cylindrical portion 66 is normally arranged substantially on the central axis of outer cylindrical portion 65 by the pair of connecting bands 67. Although not shown, a cylindrical fitting portion of the push button knob is also provided which corresponds to the square-shaped portion 54 of the embodiment shown in FIG. 6**.

In the same manner as in the first embodiment, a pair of engaging claws 69 are provided formed in the outer circumferential surface of the outer cylindrical portion 65 for engagement with suitable openings formed in the fitting portions of the push button knob assembly so that the combining members 63 and the knob are connected together. Projections **64*a* for engaging a groove 10*a* on operating rod 10 are formed in the inner cylindrical portion 66. As in the first embodiment, connecting bands 67** are very flexible in the rotational direction so that this second embodiment performs with the same effect and in the same manner as the first embodiment.

While preferred embodiments have been described, variations thereto will occur to those skilled in the art within the scope of the present inventive concepts which are delineated by the following claims.

What is claimed is:

1. In a push button switch assembly for an electronic apparatus having a push button switch, an operating rod associated with said push button switch and wherein said operating rod is movable between first and second positions to activate said push button switch and a push button knob operative to move said operating rod between its said first and second positions, the improvement comprising means for positively and resiliently coupling said operating rod to said push button knob comprising:

a coupling member having a first segment for positively and securely engaging a free end of said operating rod;

a second segment spaced radially from said first segment for positively and securely engaging said push button knob; and elastic and resilient connecting members interconnecting said first and second segments of said coupling members to provide a resilient and flexible interconnection between said first and second segments in all directions except in the direction of movement of said operating rod when said rod moves between its first and second positions.

2. A push button switch assembly according to claim 1 wherein said coupling member is formed of a synthetic resin material.

3. A push button switch assembly according to claim 1 wherein said connecting members interconnecting said first and second segments are relatively thin and narrow so as to be relatively flexible.

4. A push button switch assembly according to claim 1 wherein said first and second segments and said connecting members interconnecting said first and second segments are integrally molded of a synthetic resin material.

5. A push button switch assembly according to claim 1 wherein said first segment includes an internal protruding member for engagement with a depression in said free end of said operating rod to positively and securely engage said first segment with said operating rod.

6. A push button assembly according to claim 1 wherein said push button knob includes a peripheral segment therein having a recess and wherein said second segment includes a projecting segment adapted to engage within said recess on said second segment to securely engage said push button knob with said second segment.

* * * * *